US007495422B2

(12) United States Patent
Mok et al.

(10) Patent No.: US 7,495,422 B2
(45) Date of Patent: Feb. 24, 2009

(54) AREA-EFFICIENT CAPACITOR-FREE LOW-DROPOUT REGULATOR

(75) Inventors: Kwok Tai Philip Mok, Clear Water Bay (HK); Sai Kit Lau, Tseung Kwan O (HK); Ka Nang Leung, Tokwawan (HK)

(73) Assignee: Hong Kong University of Science and Technology, Hong Kong (CN)

( * ) Notice: Subject to any disclaimer, the term of this patent is extended or adjusted under 35 U.S.C. 154(b) by 203 days.

(21) Appl. No.: 11/457,411

(22) Filed: Jul. 13, 2006

(65) Prior Publication Data

US 2007/0018621 A1 Jan. 25, 2007

Related U.S. Application Data

(60) Provisional application No. 60/701,373, filed on Jul. 22, 2005.

(51) Int. Cl.
*G05F 1/40* (2006.01)

(52) U.S. Cl. ..... 323/280

(58) Field of Classification Search ..... 323/265, 323/273, 280, 349

See application file for complete search history.

(56) References Cited

U.S. PATENT DOCUMENTS 6,208,206 B1 * 3/2001 Leung et al. ..... 330/107
6,304,131 B1 * 10/2001 Huggins et al. ..... 327/538
6,977,490 B1 * 12/2005 Zhang et al. ..... 323/280
7,109,897 B1 * 9/2006 Levesque ..... 341/67
7,167,054 B1 * 1/2007 Dening et al. ..... 330/297

OTHER PUBLICATIONS

Leung et al., "A Capacitor-Free CMOS Low-Dropout Regulator With Damping-Factor-Control Frequency Compensation," IEEE Journal of Solid-State Circuits, vol. 38, No. 10, Oct. 2003, pp. 1691-1702.

* cited by examiner

*Primary Examiner*—Adolf Berhane
(74) *Attorney, Agent, or Firm*—Schwabe, Williamson & Wyatt, P.C.

(57) ABSTRACT

An area-efficient capacitor-free low-dropout regulator based on a current-feedback frequency compensation technique is disclosed. An implementation of a current feedback block with a single compensation capacitor is used to enable capacitance reduction. The resultant low-dropout regulator does not generally require an off-chip capacitor for stability and is particularly useful for system-on-chip applications.

29 Claims, 8 Drawing Sheets

AREA-EFFICIENT CAPACITOR-FREE LOW-DROPOUT REGULATOR

CROSS-REFERENCE TO RELATED APPLICATION

This application claims the benefit of U.S. Provisional Application No. 60/701,373, filed Jul. 22, 2005, entitled "Chip-Area-Efficient Capacitor-Free Low-Dropout Regulator," which application is incorporated in its entirety by reference as if fully set forth herein.

FIELD OF THE INVENTION

This invention relates to frequency compensation technique for low-voltage capacitor-free low-dropout regulators, in particular to such regulators which do not require an off-chip capacitor for stability, and to low-dropout regulators or amplifiers incorporating such techniques.

BACKGROUND OF THE INVENTION

Conventionally, an off-chip output capacitor is required for achieving low-dropout regulator (LDO) stability, as well as good line and load regulations. However, the off-chip capacitor is the main obstacle to fully integrating the LDO in system-on-chip (SoC) applications. With the recent rapid development of SoC designs, there is a growing trend towards the integration of integrated circuits systems and power-management circuits. Local, on-chip and capacitor-free LDO regulators are important for future SoC applications. The capacitor-free feature significantly reduces system cost and board space, and also simplifies system design since external off-chip capacitor is eliminated.

Generally, for high-precision applications, a high low-frequency gain of the LDO regulators is required. A particular problem is that as the power supply voltage is scaled down in the current trends, the threshold voltage is not necessarily scaled down in the same way. At low supply voltages, cascade topology is no longer suitable for achieving high low-frequency gain. Instead, multi-stage approach is widely used by cascading several stages horizontally. However, the stability and the bandwidth of the LDO regulators with cascaded approach are both limited by the existing frequency compensation techniques. Currently, due to the stability issue, state-of-the-art capacitor-free LDO regulators need a minimum load current, typically around 10 mA, to be stable under normal operation. However, this minimum load current requirement is a major obstacle to applying capacitor-free LDO regulators in system-on-chip applications.

PRIOR ART

Frequency compensation techniques for LDO regulators with cascaded approach are increasingly demanded in low-voltage designs. One very well known prior frequency compensation technique is nested Miller-based compensation which is commonly used to ensure the stability of a LDO regulator with multi-stage approach. FIG. 1 shows schematically the structure of a three-stage nested Miller-based LDO regulator. The LDO regulator of FIG. 1 suffers from stability problems especially when the load current is below several milli-amperes. As shown in FIG. 2, when the load current is around several milliampere ranges, the second and third pole will cause a magnitude peak near the unity-gain frequency due to the small value of the damping factor of the second order function of the second and third poles of the LDO regulator. One possible solution to extend the minimum load current is to use a large compensation capacitor $C_{ml}$. However, this is not an effective solution as the frequency response and transient performance are sacrificed. In addition, both chip area and cost are increased significantly.

SUMMARY OF THE INVENTION

According to the present invention, there is provided a three-stage capacitor-free low-dropout regulator comprising: first, second and third gain stages wherein said first gain stage having a differential input stage and a single-ended output, a high-swing second gain stage with input connecting to the output of the first stage and a single-ended output, a power PMOS transistor as the third gain stage with gate terminal connecting to the output of the second stage, source terminal connecting to the input voltage, and drain terminal connecting to the output of the regulator. A capacitor is connected between the output of the first stage and the output of the regulator while a voltage reference is connected to the negative of the error amplifier. A current feedback block is for feeding back a small-signal current that is proportional to the time derivative of the output voltage of the second stage to the output of the first stage. It can control the damping factor of the second and third complex poles of the said regulator so as to improve the stability of the regulator without using a large compensation capacitor $C_{ml}$ and sacrificing the performance.

The regulator may preferably be provided with a feedforward transconductance stage extending from the output of the first stage to the output of the regulator to further improve both frequency and dynamic responses.

BRIEF DESCRIPTION OF THE DRAWINGS

An embodiment of the invention will now be described by way of example and with reference to the accompanying drawings, in which.

DETAILED DESCRIPTION OF PREFERRED EMBODIMENT

Figure 3A:
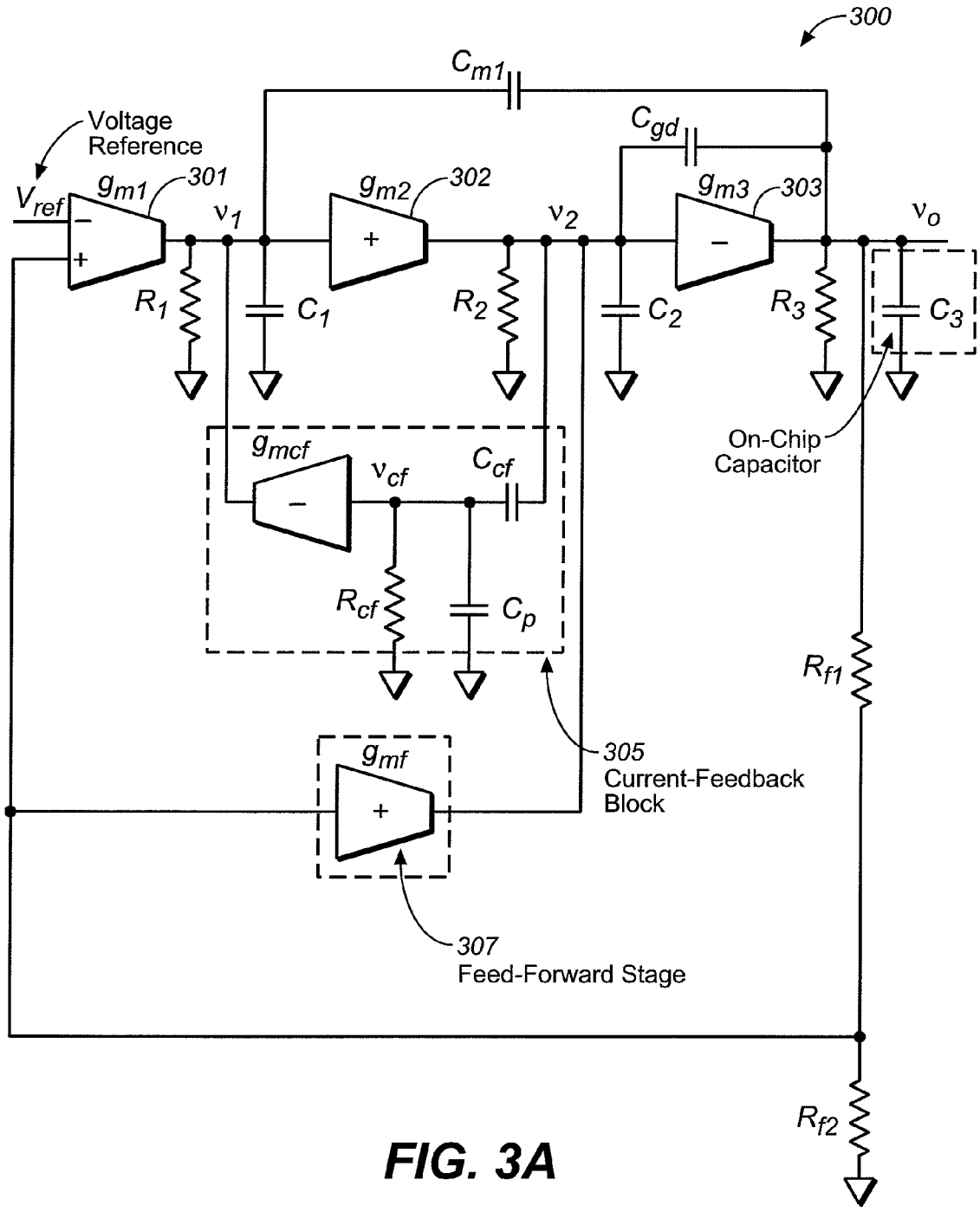
FIG. 3A is a schematic circuit diagram illustrating the structure of the capacitor-free LDO regulator according to an embodiment of the present invention.

Referring to FIG. 3A there is shown schematically the structure of a capacitor-free low-dropout regulator 300 according to a preferred embodiment of the invention. The capacitor-free LDO regulator comprises of three gain stages. The first gain stage 301 is a high-gain error amplifier having a differential input and single-ended output gain stage with transconductance $g_{m1}$, where the inverting terminal is connected to the output of the voltage reference while the non-inverting terminal is connected to a feedback resistor $R_{f1}$, and has an output resistance $R_1$ and a parasitic capacitance $C_1$. A second stage 302 receives the output signal of the first stage 301 and is a positive gain stage with transconductance $g_{m2}$, output resistance $R_2$ and parasitic capacitance $C_2$. A third gain stage 303 receives the output signal of second stage 302 and is a negative gain stage with transconductance $g_{m3}$ and output resistance $R_3$. In addition, $C_3$ is the on-chip capacitance.

As there are three gain stages, a high low-frequency loop gain is achieved which provides good line and load regulations and therefore, high-precision output voltage is obtained. However, there are three high-impedance nodes and hence three low-frequency poles are associated with the capacitor-free LDO 300. The said LDO 300 is potentially unstable, especially at the low load current condition. Therefore, an advanced frequency compensation technique is required to stabilize the capacitor-free LDO 300.

Figure 1:
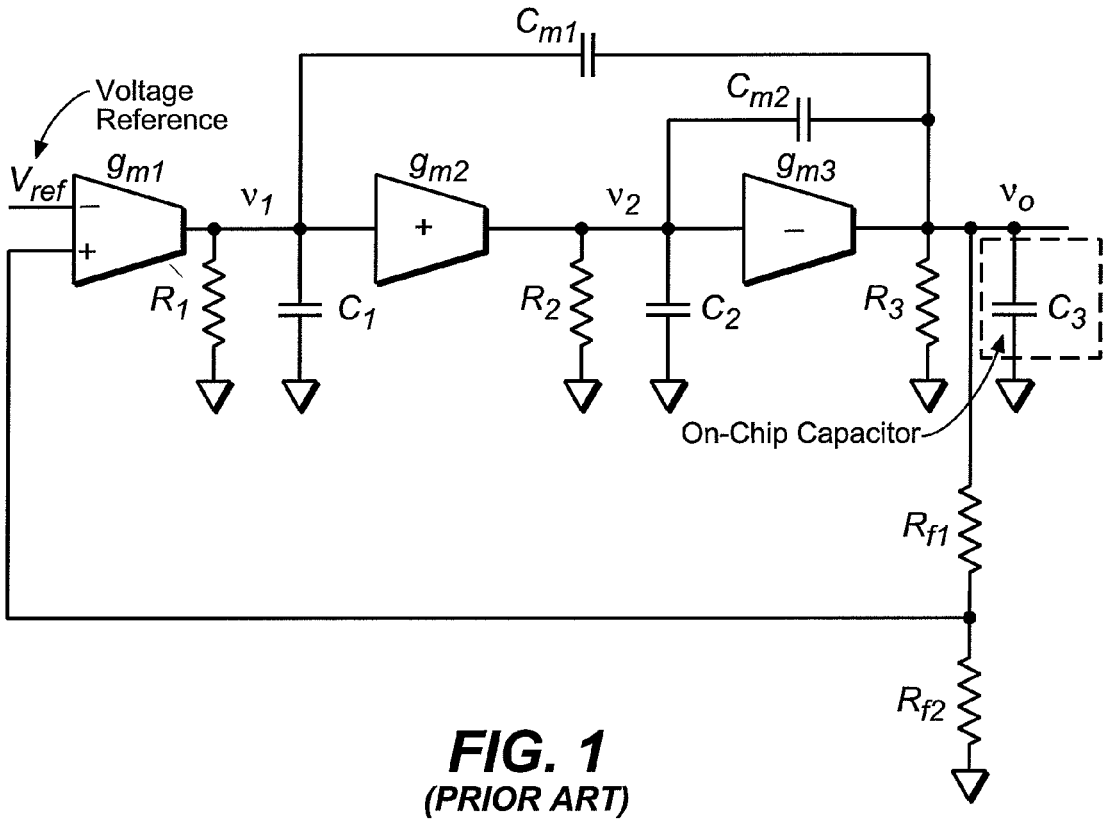
FIG. 1 (PRIOR ART)
FIG. 1 is a schematic circuit diagram illustrating a frequency compensation technique according to the prior art.
Figure 2:
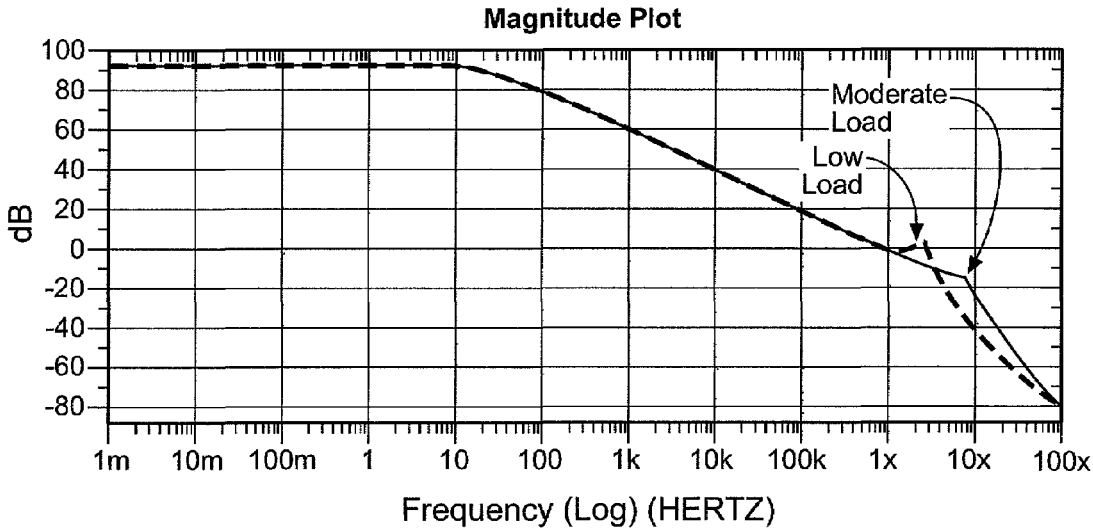
FIG. 2 is a Bode plot of capacitor-free LDO regulator constructed in accordance with the prior art of FIG. 1 at low and moderate current.
Figure 2:
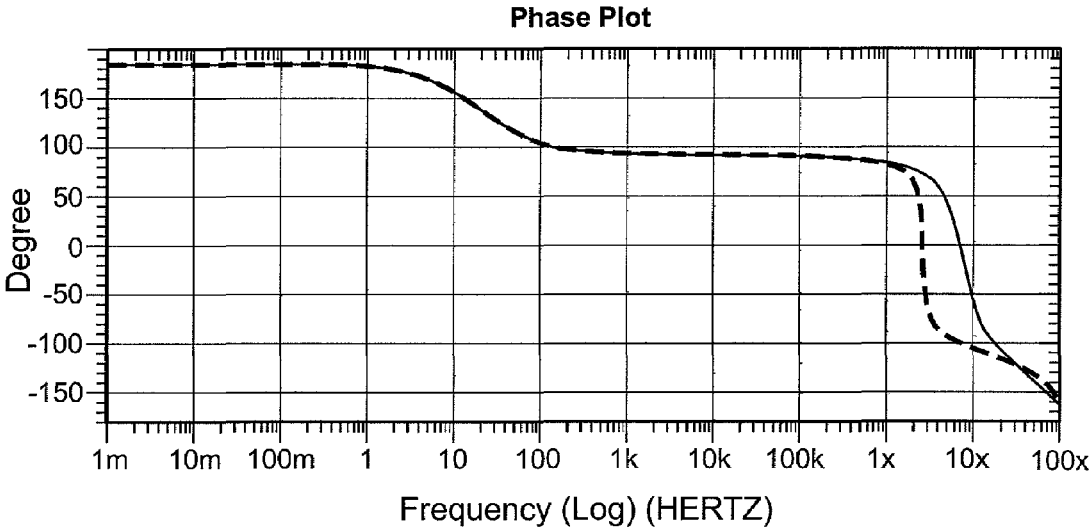

The stability of LDO 300 is illustrated In FIG. 3A is achieved by using an extra current-feedback block 305 with a compensation capacitor $C_{cf}$ which is connected between the output of first stage 301 and the output of second stage 302. current-feedback block 305 has a negative gain stage with transconductance of $g_{mcf}$. The compensation capacitor $C_{cf}$ feeds back the small-signal current proportional to the time derivative of the output of second stage 302 to the node $v_{cf}$ with an input resistance $R_{cf}$ and a parasitic capacitance $C_p$. The transconductance cell $-g_{mcf}$ senses the small-signal voltage at the node $v_{cf}$ and generates a small-signal current to the output of first stage 301. This current-feedback block encloses a negative feedback around the loop with the $-g_{mcf}$ and $g_{m2}$ transconductance stages. This negative feedback loop improves the frequency response performance of the capacitive-free LDO 300. An additional compensation capacitor $C_{m1}$ is connected between the output of first stage 301 and the output of the capacitive-free LDO 300. At low and moderate load current ranges, compared with the conventional design in FIG. 1, the quality factor of the circuit in FIG. 3A is decreased. This means the effect of the magnitude peaking will be smaller for the same loading currents. Moreover, quality factor will be further reduced by decreasing the compensation capacitor $C_{m1}$. In other words, having the same minimum loading current value for SoC applications, the required compensation capacitor $C_{m1}$ of the circuit in FIG. 3A will be smaller and therefore higher unity-gain-frequency and faster load transient response are achieved. In addition, the chip area and costs are much reduced as large compensation capacitor $C_{m1}$ is not required.

Figure 3B:
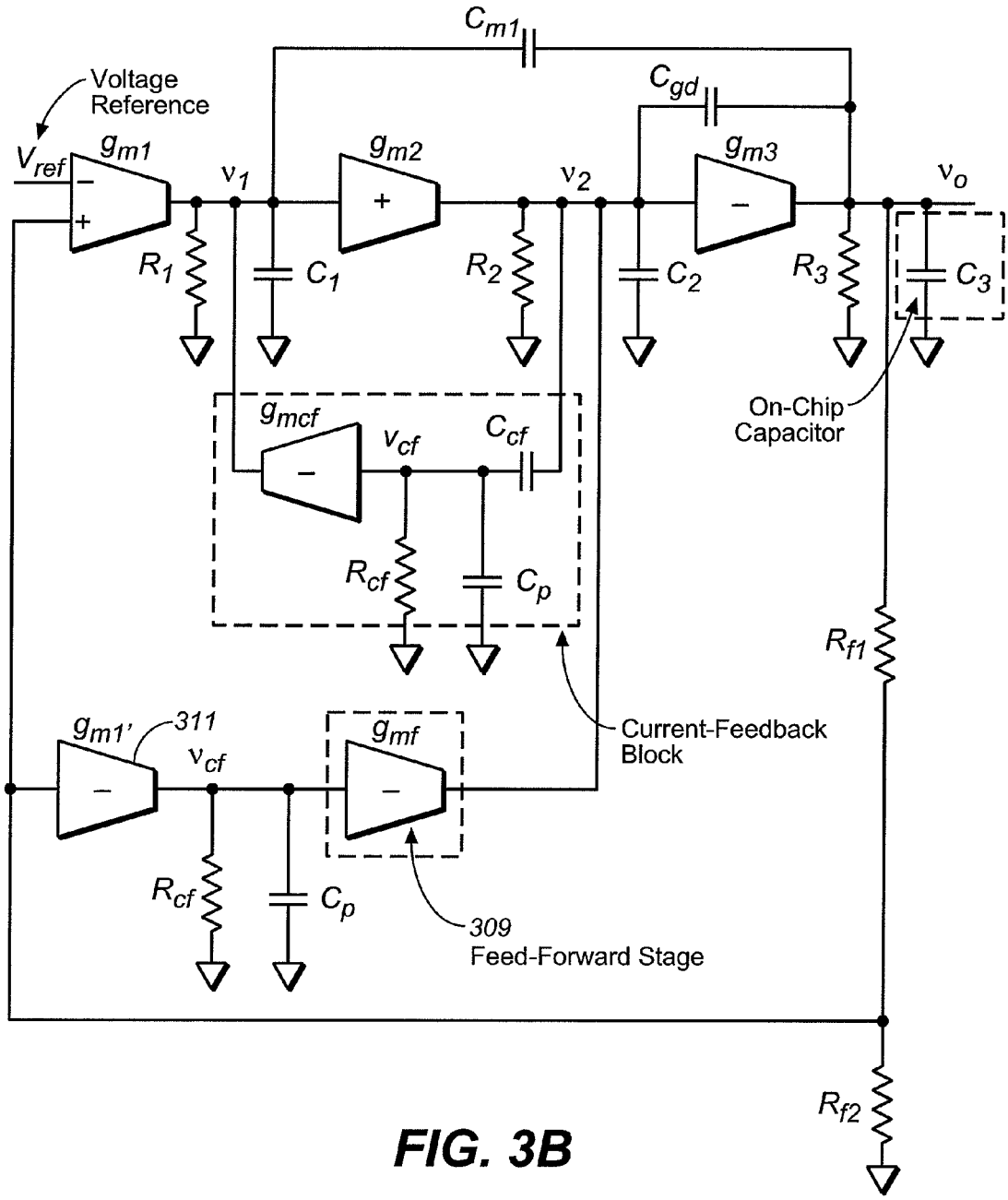
FIG. 3B is an alternative schematic of the circuit of FIG. 3A with a feed-forward stage in a different configuration.

FIG. 3B shows an alternative schematic to that of FIG. 3A where feedforward stage 309 is not directly coupled to the input of first stage 301, but instead is connected through a gain stage 311 having a transconductance $g_{m1}'$. In some cases, transconductance stage $g_{m1}$ and $g_{m1}'$ are implemented together so that they share certain components.

Figure 3C:
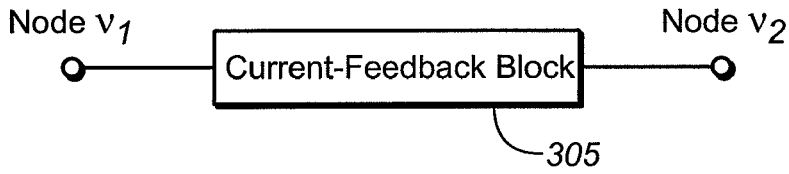
FIG. 3C shows the current feedback block of FIG. 3A connected between two nodes of the circuit.

FIG. 3C shows a current-feedback block 305 that is connected between two nodes of the circuit of FIG. 3A.

Figure 3D:
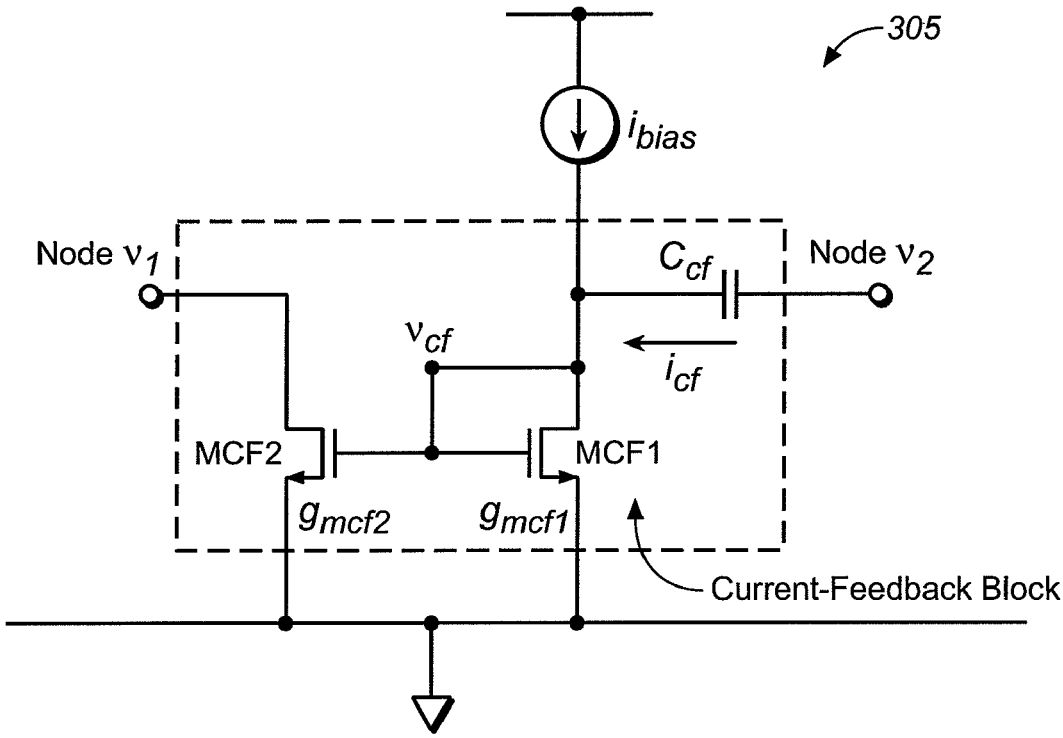
FIG. 3D shows a more detailed view of one embodiment of the current-feedback block of FIG. 3C.

FIG. 3D shows a circuit diagram of one implementation of current feedback block 305 of FIG. 3C. Current feedback block 305 includes two transistors MCF1 and MCF2, having their gates connected together. Transistor MCF1 is in a diode connected configuration and receives a bias current $i_{bias}$ and a current input $i_{cf}$ from node v2. The current feedback block acts as a current buffer that tends to produce a current through transistor MCF2 that is equal to that through transistor MCF1.

Figure 4:
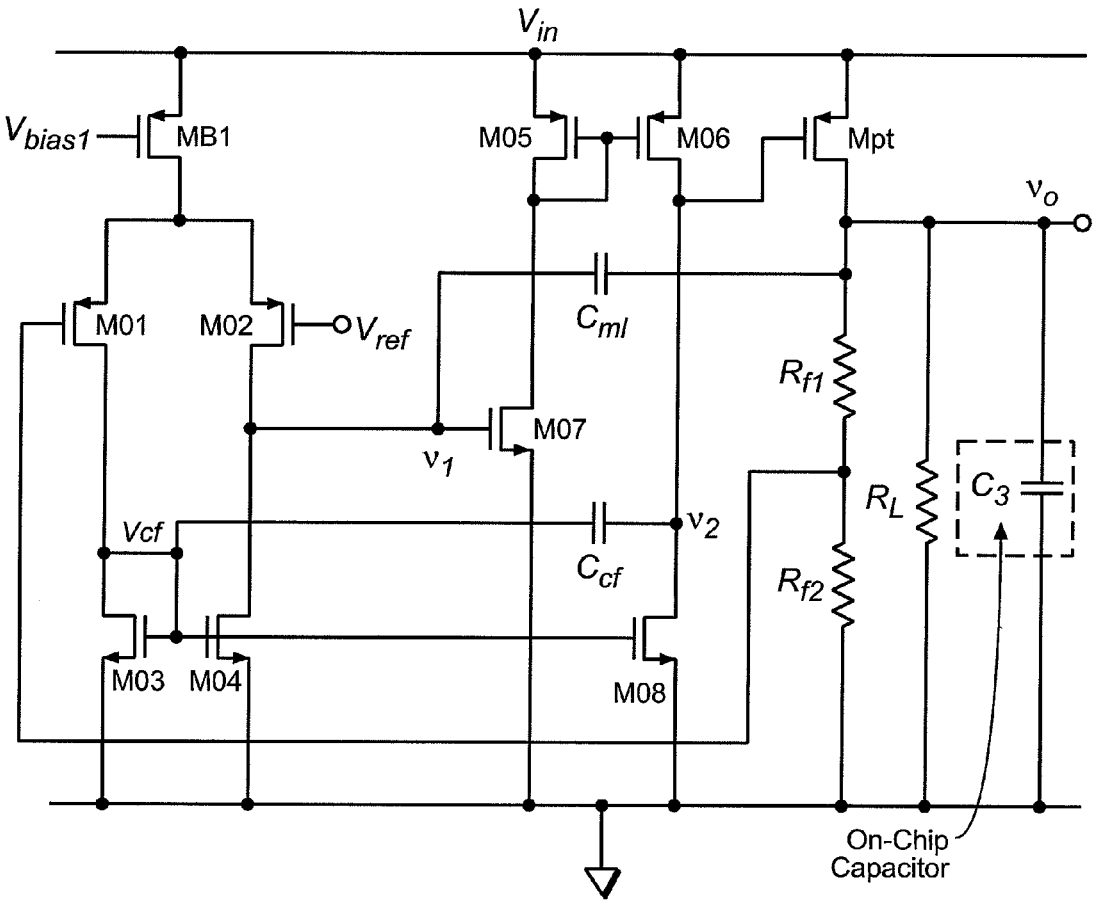
FIG. 4 is a detailed circuit diagram showing one possible implementation of the embodiment of FIG. 3A.
Figure 5:
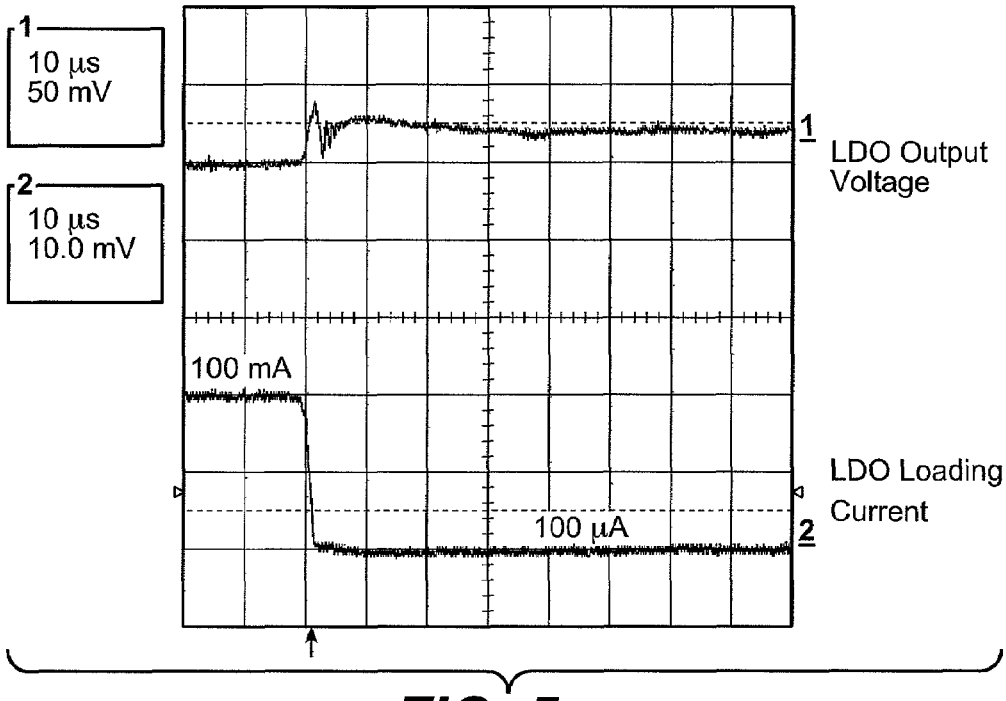
FIG. 5 is a plot showing the transient response of the capacitor-free LDO regulator of FIG. 4 from 100 mA to 100 μA when driving a 100 pF capacitive load.
Figure 6:
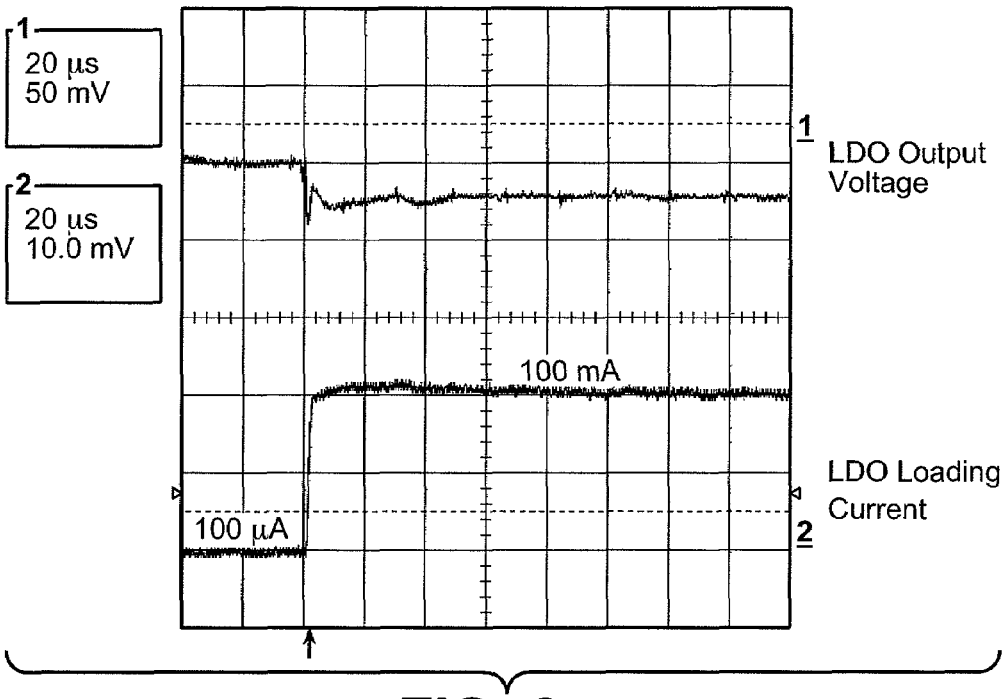
FIG. 6 is a plot showing the transient response of the capacitor-free LDO regulator of FIG. 4 from 100 μA to 100 mA when driving a 100 pF capacitive load.

FIG. 4 is a detailed circuit implementation at transistors level of one possible realization of the capacitive-free LDO according to the embodiment of the invention as shown in FIG. 3A. The capacitive-free LDO in accordance with this embodiment of invention has been fabricated using CMOS technology. In the embodiment of FIG. 4, the current feedback block shares certain devices with the first gain stage. For example, transistors M03 and M04 may be considered to be shared between the first gain stage and the current feedback block. This is an alternative arrangement to that of FIG. 3D which shows a current feedback block that does not share devices. Also, the feed-forward stage of FIG. 4 shares certain devices with the first stage. For example, M01 and M03 may be considered to be shared. The measured load transient responses from 100 μA to 100 mA and from 100 mA to 100 μA with 100 pF capacitive load are shown in FIG. 5 and FIG. 6, respectively. FIG. 5 shows the effect of a drop in the load current from 100 mA to 100 μA. The lower trace shows the change in current, while the upper trace shows the small change in output voltage. FIG. 6 shows the effect of an increase in the load current from 100 μA to 100 mA. The lower trace shows the change in current while the upper trace shows the small change in output voltage. From the measurement results, the capacitive-free LDO in accordance with this embodiment of invention is absolutely stable for the load current down to hundred microamperes. This shows the LDO in accordance with this embodiment of invention is highly suitable for SoC applications as the minimum load current restrictions are greatly improved.

As the parasitic capacitor at the gate of the power pass transistor is usually large, a feedforward transconductance gain stage with a transconductance $g_{mf}$ is implemented to form a class-AB push-pull gain stage. This can improve both the frequency response and eliminate slew-rate limitation. The feedforward transconductance stage is implemented by the transistor M08, as shown in FIG. 4.

For SoC designs, the loading capacitor is assumed to be the capacitance coming from the power lines. Under this circumstance, the equivalent series resistance does not exist. Moreover, the power PMOS pass transistor is designed to operate in linear region at the minimum supply voltage and maximum loading current. Thus, the required pass transistor size can be significantly reduced for ease of integration and cost reduction.

In order to provide a clearer insight to the proposed structure and without losing accuracy, the following assumptions are made to simplify the transfer function.

1) $C_1$, $C_2$, $C_p$ and $C_{gd}$ are the parasitic capacitors (where $C_{gd}$ is the parasitic gate-to-drain capacitor of the power pass transistor).
2) The resistance at the current feedback node $v_{cf}$ is equal to the reciprocal of its transconductance (i.e. $R_{cf}=1/g_{mcf}$).
3) The gain of each stage is much greater than one.
4) $C_{m1}$ and $C_{cf}$ are the compensation capacitors.

With these assumptions, the small-signal voltage gain transfer function of the capacitive-free LDO regulator in FIG. 3A is given by:

$$\frac{-g_{m1}g_{m2}g_{m3}R_1R_2R_3\left(1+\frac{sC_{m1}g_{mf}}{g_{m1}g_{m2}}\right)\left(\frac{R_{f2}}{R_{f1}+R_{f2}}\right)}{(1+sC_{m1}g_{m2}g_{m3}R_1R_2R_3)\times\left[1+s\frac{C_{m1}C_{gd}(g_{m3}-g_{m2})+C_{cf}C_3g_{m2}+C_{m1}C_{cf}g_{m2}g_{m3}R_{cf}}{C_{m1}g_{m2}g_{m3}}+s^2\frac{(C_{gd}+C_2+C_{cf})C_3}{g_{m2}g_{m3}}\right]}$$

From the above equation, the feedforward stage $g_{mf}$ removes the right-half-plane (RHP) zero and generates a left-half-plane (LHP) zero to provide a positive phase shift and compensate the negative phase shift of the non-dominant poles. This helps to improve the phase margin of the voltage regulator. From the circuit implementation point of view, the power consumption will not be increased with the feedforward transconductance stage while dynamic performance of the LDO is improved.

Figure 7:
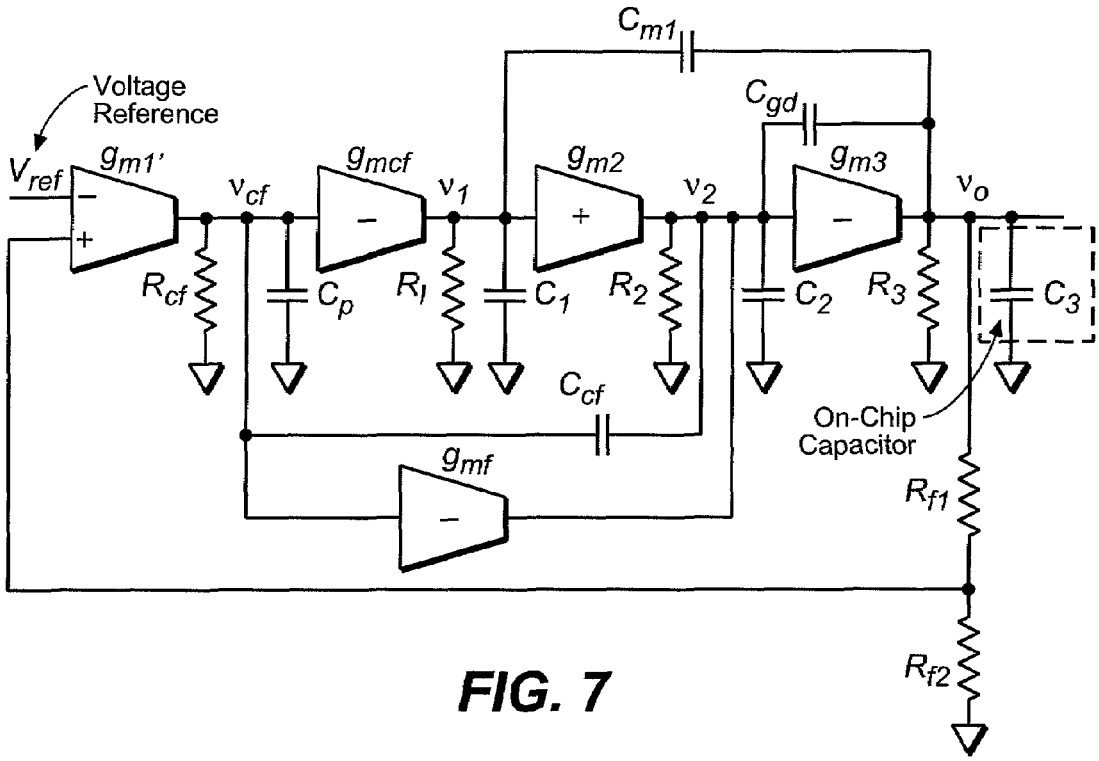
FIG. 7 is a circuit diagram showing a second embodiment of the invention.
Figure 8:
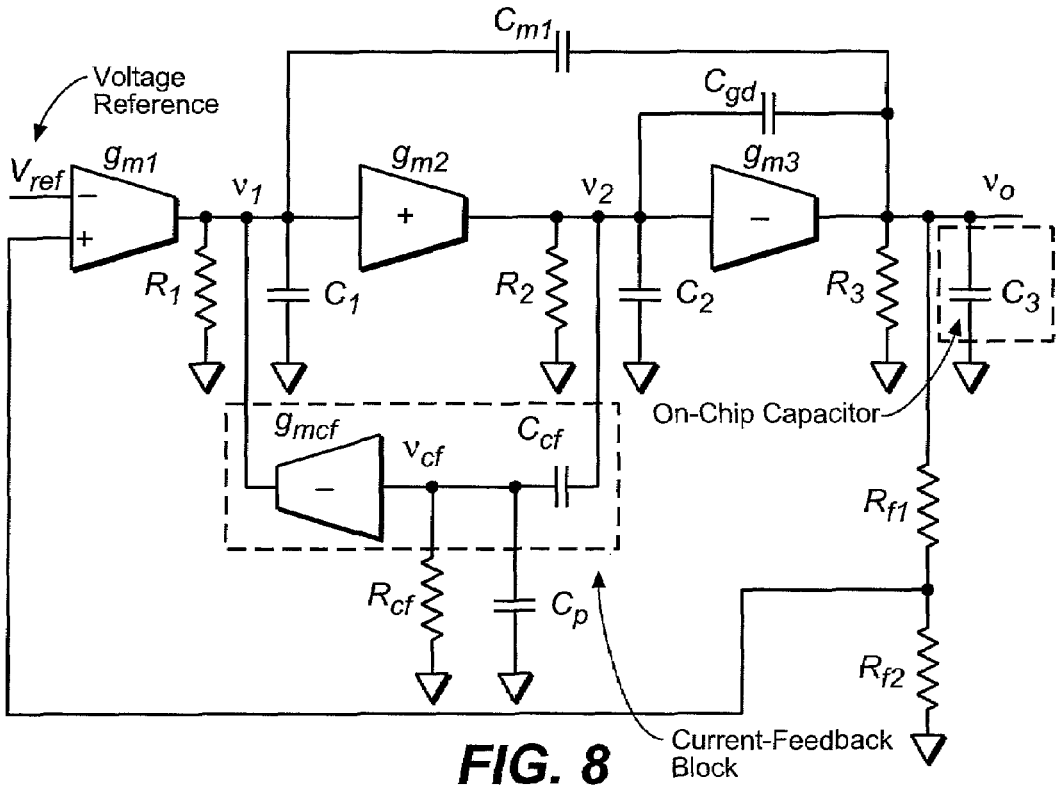
FIG. 8 is a circuit diagram showing a third embodiment of the invention.

In the embodiment of FIG. 3A the capacitive-free low-dropout regulator is provided with a feedforward transconductance stage. An equivalent structure is shown in FIG. 7, in which the current buffer is embedded in the first stage. FIG. 3A and FIG. 7 may be considered to be two possible equivalent structures that each correspond to the circuit of FIG. 4. Thus, in some cases, part of the current feedback block may be considered to also be part of the first stage, while in others, it may be considered to be a separate component. While a feedforward transconductance stage is preferred, it is not essential and FIG. 8 shows schematically an embodiment similar to that of FIG. 3A but without the feedforward transconductance stage.

An example of the present invention has been described above but it will be understood that a number of variations may be made to the circuit design without departing from the spirit and scope of the present invention. At least in its preferred forms the present invention provides a significant departure from the prior art both conceptually and structurally. While a particular embodiment of the present invention has been described, it is understood that various alternatives, modifications and substitutions can be made without departing from the concept of the present invention. Moreover, the present invention is disclosed in CMOS implementation but the present invention is not limited to any particular integrated circuit technology and also discrete-component implementation.

What is claimed is:

1. A low-dropout regulator, comprising:

a first amplifier stage having a first input, a second input, and a first stage output, wherein the first input is coupled to a reference voltage;

a positive-gain second amplifier stage having a second stage output and a second stage input that is coupled to the first stage output;

a power PMOS transistor having a drain terminal coupled to an output node, a gate terminal coupled to the second stage output, and a source terminal coupled to an input supply voltage;

a feedback resistor coupled between the output node and the second input;

a compensation capacitor coupled between the first stage output and the output node;

a current-feedback block coupled between the second stage output and a node of the first amplifier stage.

2. The low-dropout regulator of claim 1, wherein the node of the first amplifier stage is the first stage output.

3. The low-dropout regulator of claim 1, wherein the node of the first amplifier stage is an internal node of the first amplifier stage.

4. The low-dropout regulator of claim 1, further comprising a feedforward transconductance stage having an input that is coupled to the second input and an output that is coupled to the gate terminal of the power PMOS transistor.

5. The low-dropout regulator of claim 1, wherein the power PMOS transistor operates in either linear or saturation modes.

6. The low-dropout regulator of claim 1, further comprising a fully integrated on-chip capacitor at the output node.

7. The low-dropout regulator of claim 1, wherein the second amplifier stage is a high-swing positive-gain stage which is in common-source configuration.

8. The low-dropout regulator of claim 1, wherein the current-feedback block comprises a second compensation capacitor and a current buffer, wherein a terminal of the second compensation capacitor is coupled between the second stage output and an input of the current buffer, and wherein an output of the current buffer is coupled to the first stage output.

9. The low-dropout regulator of claim 1, wherein the current-feedback block comprises a second compensation capacitor, wherein the first amplifier stage is formed by a first cascade-connected negative gain circuit and a second cascade-connected negative gain circuit, and wherein the second compensation capacitor is coupled between the second stage output and a negative output of the first cascade-connected negative gain circuit.

10. The low-dropout regulator of claim 9, further comprising a feedforward transconductance stage coupled between an output of the first cascade-connected negative gain circuit and the second stage output.

11. The low-dropout regulator of claim 9, further comprising a feedforward transconductance stage coupled between the second input and the second stage output.

12. The low-dropout regulator of claim 9, wherein the second cascade-connected negative gain stage comprises two active load transistors, wherein one of the active load transistors is a diode-connected transistor whose drain terminal and gate terminal are coupled together while the source terminal is coupled to ground, wherein the other one of the active load transistors is in common-source configuration with its gate terminal coupled to the gate terminal of the diode-connected transistor, its drain terminal coupled to the first stage output, and its source terminal coupled to ground, and wherein the second compensation capacitor is coupled to the gate terminal of the diode-connected transistor.

13. The low-dropout regulator of claim 1, wherein the current-feedback block is a negative amplifier stage with a second compensation capacitor, and wherein the current-feedback block is coupled between the first stage output and the second stage output.

14. The low-dropout regulator of claim 1, wherein the current-feedback block feeds back a small-signal current proportional to the time derivative of the second stage output to the first stage output.

15. The low-dropout regulator of claim 1, wherein the current-feedback block encloses a negative feedback loop around the current-feedback block and the second amplifier stage.

16. The low-dropout regulator of claim 1, further comprising a class-AB push-pull feedforward transconductance stage implemented at the gate terminal of the power PMOS transistor.

17. The low-dropout regulator of claim 1, wherein a parasitic drain-to-gate capacitor of the power PMOS transistor provides frequency compensation.

18. The low-dropout regulator of claim 1, wherein the reference voltage is a supply-independent and temperature-independent stable voltage that defines an output voltage of the low-dropout regulator.

19. The low-dropout regulator of claim 1, wherein the regulator is implemented in an integrated circuit.

20. The low-dropout regulator of claim 1, wherein the regulator is coupled to an off-chip capacitance.

21. A low-dropout regulator, comprising:

a first amplifier stage having a first input, a second input, and a first stage output coupled to a first node, wherein a voltage provided to the first stage output is determined by a voltage difference between the first input and the second input, and wherein the first input is provided with a reference voltage;

a second amplifier stage having a second stage input coupled to the first node and a second stage output coupled to a second node;

a third amplifier stage having a third stage input coupled to the second node and a third stage output coupled to a third node;

a feedback resistor coupled between the third node and the second input;

a feedback capacitor coupled between the first node and the third node;

a current-feedback block having an input coupled to the second node and an output coupled to the first node; and a feedforward transconductance stage having an input coupled to the second input and an output coupled to the second node.

22. The low-dropout regulator of claim 21, wherein the third amplifier stage comprises a power PMOS transistor having a drain terminal coupled to the third node and a gate terminal coupled to the second node.

23. The low-dropout regulator of claim 21, wherein the current-feedback block includes a current buffer and a capacitor.

24. A method of providing a stable output voltage, comprising:

providing a reference voltage to a first input of a first stage, wherein the first stage provides a first stage output that is an amplifier function of the voltage difference between the first input and a second input;

providing the first stage output to a second stage that provides an amplified second stage output;

providing the second stage output to a third stage, wherein the third stage provides a third stage output, and wherein the third stage includes a power transistor coupled between a supply voltage and the third stage output;

providing a first feedback signal from the third stage output to the second input, wherein the first feedback signal passes through a resistor;

providing a second feedback signal from the third stage output to the first stage output, wherein the second feedback signal passes through a capacitor; and providing a third feedback signal to the first stage output, wherein the third feedback signal is generated from the second stage output.

25. The method of claim 24, wherein the third feedback signal is generated by another capacitor and a negative gain stage coupled in series between the third stage output and the first stage output.

26. The method of claim 24, further comprising providing a feed forward signal from the second input to the third stage.

27. An apparatus, comprising:

a first amplifier stage having a first input, a second input, and a first stage output, wherein the first input is coupled to a reference voltage;

a positive-gain second amplifier stage having a second stage output and a second stage input that is coupled to the first stage output;

a power PMOS transistor having a drain terminal coupled to an output node, a gate terminal coupled to the second stage output, and a source terminal coupled to an input supply voltage; and a current-feedback block coupling the second stage output and a node of the first amplifier stage, wherein the current-feedback block comprises a compensation capacitor, wherein the first amplifier stage is formed by a first cascade-connected negative gain circuit and a second cascade-connected negative gain circuit, and wherein the compensation capacitor is coupled between the second stage output and a negative output of the first cascade-connected negative gain circuit.

28. The apparatus of claim 27, further comprising a feedforward transconductance stage having an input that is coupled to the second input and an output that is coupled to the gate terminal of the power PMOS transistor.

29. The apparatus of claim 27, further comprising a class-AB push-pull feedforward transconductance stage implemented at the gate terminal of the power PMOS transistor.

* * * * *

UNITED STATES PATENT AND TRADEMARK OFFICE

CERTIFICATE OF CORRECTION

PATENT NO. : 7,495,422 B2
APPLICATION NO. : 11/457411
DATED : February 24, 2009
INVENTOR(S) : Kwok Tai Philip Mok, Sai Kit Lau and Ka Nang Leung It is certified that error appears in the above-identified patent and that said Letters Patent is hereby corrected as shown below:

Column 1, lines 29-30, "integration of integrated circuits systems and power-management circuits" should read --integration of integrated circuit systems and power-management circuits--

Column 1, line 39, "At low supply voltages, cascade" should read --At low supply voltages, cascode--

Column 3, lines 14-15, "while the non-inverting terminal is connected to a feedback resistor Rf1" should read --while the non-inverting terminal is connected to a feedback resistor Rf1 and a resistor Rf2--

Column 4, lines 25-26, "responses from 100 μA to 100 mA and from 100 mA to 100 μA with 100 pf capacitance" should read --responses from 100 mA to 100 μA and from 100 μA to 100 mA with 100 pf capacitance--

Signed and Sealed this

Twenty-second Day of June, 2010

David J. Kappos

David J. Kappos
*Director of the United States Patent and Trademark Office*